United States Patent [19]

Chevet

[11] 4,022,043

[45] May 10, 1977

[54] PLUG CHANGING MECHANISM FOR USE IN PIERCING MILLS

[75] Inventor: Michel Chevet, Montbard, France

[73] Assignee: Valti Societe Anonyme pour la Fabrication de Tubes Roulements, Paris, France

[22] Filed: Apr. 4, 1975

[21] Appl. No.: 565,262

[30] Foreign Application Priority Data

Apr. 5, 1974 France ..... 74.12188

[52] U.S. Cl. ..... 72/97; 72/209

[51] Int. Cl.[2] ..... B21B 25/02

[58] Field of Search ..... 29/26 A, 568; 90/11 A, 90/11 D; 279/1 B, 1 TS; 408/35; 72/97, 209, 370, 481

[56] References Cited

UNITED STATES PATENTS

| | | | |
|---|---|---|---|
| 3,595,109 | 7/1971 | Burroughs et al. | 408/35 X |
| 3,691,899 | 9/1972 | Antonietto et al. | 408/35 X |
| 3,747,385 | 7/1973 | Meurer | 72/97 X |
| 3,762,201 | 10/1973 | Schonfeld et al. | 72/209 |
| 3,791,257 | 2/1974 | Frazier et al. | 279/1 TS |
| 3,927,547 | 12/1975 | Schonfeld et al. | 72/97 |
| 3,931,724 | 1/1976 | Berdyansky | 72/97 |

*Primary Examiner*—Robert Louis Spruill
*Attorney, Agent, or Firm*—Brisebois & Kruger

[57] ABSTRACT

A method for changing the plug in a mandrel in which the plug is attached to the mandrel by a detachable interlocking mechanism. The plug is maintained fixed to the mandrel during the displacement of the latter through the blank following piercing and the plug is detached from the mandrel to the rear of the piercing mill towards the end of the rearward displacement of the mandrel. A new plug is then fitted on to the mandrel during the subsequent displacement of the mandrel in the direction of the piercing mill.

5 Claims, 8 Drawing Figures

2
8
9
10
11a
11b
15a
15b
14a
14b
17
16
5a
5b
12a
12b
13
3
4
18

PLUG CHANGING MECHANISM FOR USE IN PIERCING MILLS

The present invention relates to a process and an apparatus for changing the plug of a piercing mill wherein the plug is fixed to the mandrel by a detachable interlocking mechanism.

Plug changing devices are already known which can be used in piercing mills having oblique rollers wherein the plug is fixed to the mandrel during piercing by means of a device having leaf springs whose ends engage in a corresponding profile slot provided within the plug. A plug and mandrel are disconnected in the known devices by exerting a pulling force on the mandrel or on the plug which by pulling out frees the plug from the mandrel at the end of piercing when the pierced blank traversed by the mandrel is entirely located behind the rollers, whereby the mandrel which has been freed from the plug retraverses the pierced blank, the latter having been discharged, when the mandrel has passed out of the blank on the opposite side to the piercing mill.

Devices of this type suffer more particularly from the disadvantage of requiring a particularly complex and large installation for fitting and removing the plug relative to the mandrel, in view of the need to provide devices for producing the pulling force required for disconnecting plus and mandrel.

Furthermore, such devices for detaching the plug from the mandrel, which is performed at the end of piercing before the mandrel retraverses the blank, necessitates a stoppage time during the mandrel withdrawal movement following pierces in view of the installation of plug removal devices. Furthermore, during the subsequent phase of mandrel advancement in the direction of the piercing mill, the fitting of a new plug on the mandrel once again involves a stoppage of the mandrel movement in order to interlock the new plug and the mandrel.

The present invention proposes a new process and apparatus for changing the plug on a piercing mill which obviates the above-indicated disadvantages and brings about a considerable time saving between two successive piercing operations.

The apparatus according to the invention has the further advantage of being entirely automated which was not possible with the hitherto known devices.

The object of the present invention is to provide a process for changing the plug on a piercing mill in which the plug is maintained fixed to the mandrel during the piercing operation by a detachable interlocking mechanism, in which the plug is kept fixed to the mandrel during the displacement of the latter through the blank following piercing whereby the plug is detached from the mandrel to the rear of the piercing mill towards the end of the rearward displacement of the said mandrel and whereby a new plug is then fitted on the mandrel, wherein the new plug is fitted during the subsequent displacement of the mandrel in the direction of the piercing mill.

According to a preferred embodiment, the detachment of the plug from the mandrel and the fitting of the new plug on the mandrel are performed at one and the same point of the trajectory of the end of the mandrel close to the termination of the rearward displacement of this end, whereby the detachment takes place during the rearward return of the mandrel and the fitting during the forward return towards the piercing mill. However, according to a variant it is possible for the fitting of the new plug on the mandrel to take place at any random point of the mandrel trajectory, for example close to the piercing machine.

The present invention also has for its object an apparatus for performing the process described hereinbefore, whereby this apparatus comprises means arranged to the rear of the piercing mill towards the end of the rearward displacement of the mandrel after drilling for detaching the plug from the mandrel by releasing the plug-mandrel interlocking mechanism, whereby the said apparatus comprises means for fitting a plug on the end of the mandrel arranged in the displacement path of the mandrel in the direction of the piercing mill.

According to a preferred embodiment, the means for fitting a new plug on the mandrel are arranged at the same point in the trajectory as the said means for detaching the plug and in a particularly advantageous embodiment, these means can be identical or have common parts. However, as a variant, the means for fitting a new plug on the mandrel can be arranged at any other point in the trajectory, for example between the piercing mill rollers and the said means for detaching the plug from the mandrel. In advantageous manner it is also possible to provide in this case means permitting the recycling towards the plug fitting means the said plugs which have been detached by the detachment means.

According to another preferred embodiment, the apparatus according to the invention comprises a receptacle arranged at the rear of the piercing mill towards the end of the rearward displacement of the mandrel following piercing having an internal slot of adequate dimensions to contain a plug, the said receptacle having means for operating the detachable plug-mandrel interlocking mechanism in such a way that the removal of the plug takes place within the said receptacle.

The internal receptacle slot is preferably of adequate dimensions to permit the passage without jamming of the mandrel but inadequate to permit the detachment of the plug on the side of the receptacle opposite to the piercing mill.

However, according to a variant it is possible to provide no receptacle but instead provide towards the end of the rearward path of the mandrel end, means for disconnecting plug from mandrel and ensuring the discharge of the plug, for example by means of an inclined chute or any other device of this type.

According to the invention, the detachable plug-mandrel interlocking mechanism advantageously comprises locking means preventing the detachment of plug from mandrel through pulling out.

According to a special embodiment, these locking means comprise at least two hooks integral with an end fitting fixedly mounted to the end of the mandrel and penetrating an annular transverse groove having free edges of the plug and each having a planar surface which is supported on one of the edges of the said groove.

In this embodiment, the apparatus preferably has an elastic means for returning the said hooks in spaced manner towards their locking position.

In a particularly advantageous manner, the hooks can be mounted on elastic plates each having a portion which projects beyond the periphery of the end fitting, whereby an external pressure on the said projecting portions brings together the said hooks freeing them from their locking support in the annular groove of the plug.

The external pressure on the projecting portions of the elastic plates can, according to a particularly advantageous embodiment, be exerted by the wall of the inner receptacle slot during the penetration of the plug into the receptacle.

With a view to bringing about the automation of the whole apparatus, the latter can have an automatic mechanism for removing the receptacle containing the plug which has just been used and for fitting another receptacle containing a plug which is ready for use. This automatic mechanism can in particular be of the drum type, whereby the receptacles are each contained in a cavity in the drum.

However, it would also be possible to use a drum simply for receiving the detached plugs, removing by rotating the drum, the plug detached during the travel of the end of the mandrel and then recycling the plug by causing it to leave the drum at a different point of the trajectory for its refitting on the mandrel. The receptacles can also be moved towards and spaced from the position corresponding to the fitting and removal of the plugs on a linear transporting device comprising a stopping station on the mandrel displacement path when the latter moves to the rear of the piercing mill after the drilling operation.

Obviously, although the invention has been described in conjunction with a piercing mill, it can also be used for other types of rolling mills using a plug and mandrel and wherein it is desired to fit and remove the plug relative to the mandrel to the rear of the rolling mill rollers towards the end of the rearward displacement of the mandrel after piercing.

With the object of providing a better understanding of the invention, hereinafter a non-limitative exemplified embodiment is described with reference to the drawings, in which FIG. 1 shows schematically the different phases of fitting and removing the plug in the apparatus according to the invention.

Figure 1:
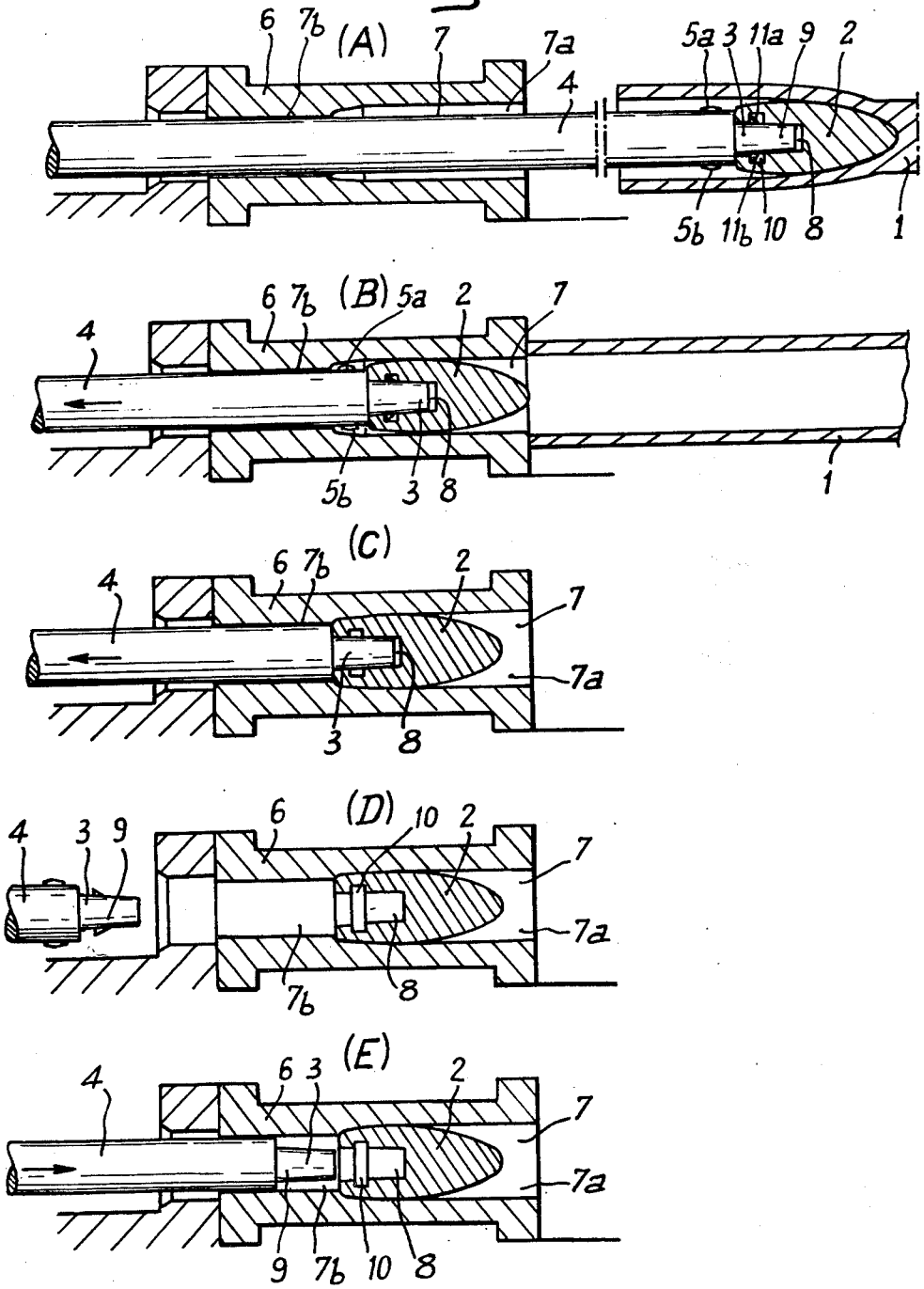

Diagram A in FIG. 1 shows the apparatus according to the invention during the piercing of a blank in a piercing mill having oblique rollers (not shown).

Piercing performed by a substantially conical plug 2 fixed, in a manner to be described hereinafter, to an end fitting 3 secured to a cylindrical mandrel 4. The end fitting 3 is provided with elastic portions 5*a* and 5*b* projecting beyond the external periphery.

Diagram A also shows a receptacle 6 having an internal slot 7 which encircles spindle 4. Plug 2 has a cavity 8 wherein is engaged the end 9 of end fitting 3 secured to spindle 4. Plug 2 also has an annular groove 10 wherein are engaged two grips 11*a* and 11*b* which will be described in greater detail with reference to FIGS. 2 and 3.

Diagram B in FIG. 1 shows the apparatus during the wthdrawal phase of Mandrel 4 once blank 1 has been pierced. As can seen, during the withdrawal of mandrel 4, plug 2 remains fixed and penetrates slot 7 of receptacle 6.

Slot 7 has two portions of different diameters, namely a front portion 7*a* of larger diameter substantially corresponding to the external diameter of the plug and a rear portion 7*b* of smaller diameter substantially corresponding to the external diameter of mandrel 4 and less than the external diameter of plug 2. thus, the receptacle 6 is designed in such a way that the plug can penetrate and be contained wholly within portion 7*a* but cannot be discharged rearwards into portion 7*b*.

During the subsequent withdrawal of the mandrel shown in Diagram C, the projecting portions 5*a* and 5*b* of end fitting 3 are compressed by the walls of slot 7*b* of receptacle 6 due to the difference in diameter of portion 7*a* and 7*b* which, as will be described in greater detail with reference to FIGS. 2 and 3, cancels out the projecting portions 5*a* and 5*b* and frees grips 11*a* and 11*b* from annular groove 10 of the plug. As can be seen in Diagram D a plug 2 released in this way remains in portion 7a of slot 7 of receptacle 6 and mandrel 4 is withdrawn rearwards from the receptacle.

At this time, by means of an automatic mechanism, for example of the drum type, receptacle 6 is replaced by another receptacle 6 having identical characteristics and dimensions containing a new plug 2 which is ready to be used for piercing.

When this change has taken place, the mandrel 4 is again introduced at the rear of receptacle 6 (Diagram E) in such a way that the end of its end fitting 9 penetrates cavity 8 of the plug ensuring the locking together of plug and mandrel by fitting the elastic hooks 11*a* and 11*b* in the corresponding annular groove 10 of plug 2.

The mandrel then continues to move forwards and drilling is carried out in the position shown in Diagram A.

Thus, the fitting and removal of the plug relative to mandrel are performed entirely within the receptacle 6, the plug being replaced merely by changing the receptacle. This receptacle change phase can be synchronized with the rearward withdrawal of the plug from the receptacle shown in Diagram D and thus the worn plug can be replaced by a new plug without loss of time and in a particularly simple and precise manner.

Figures 2, 3, 4:
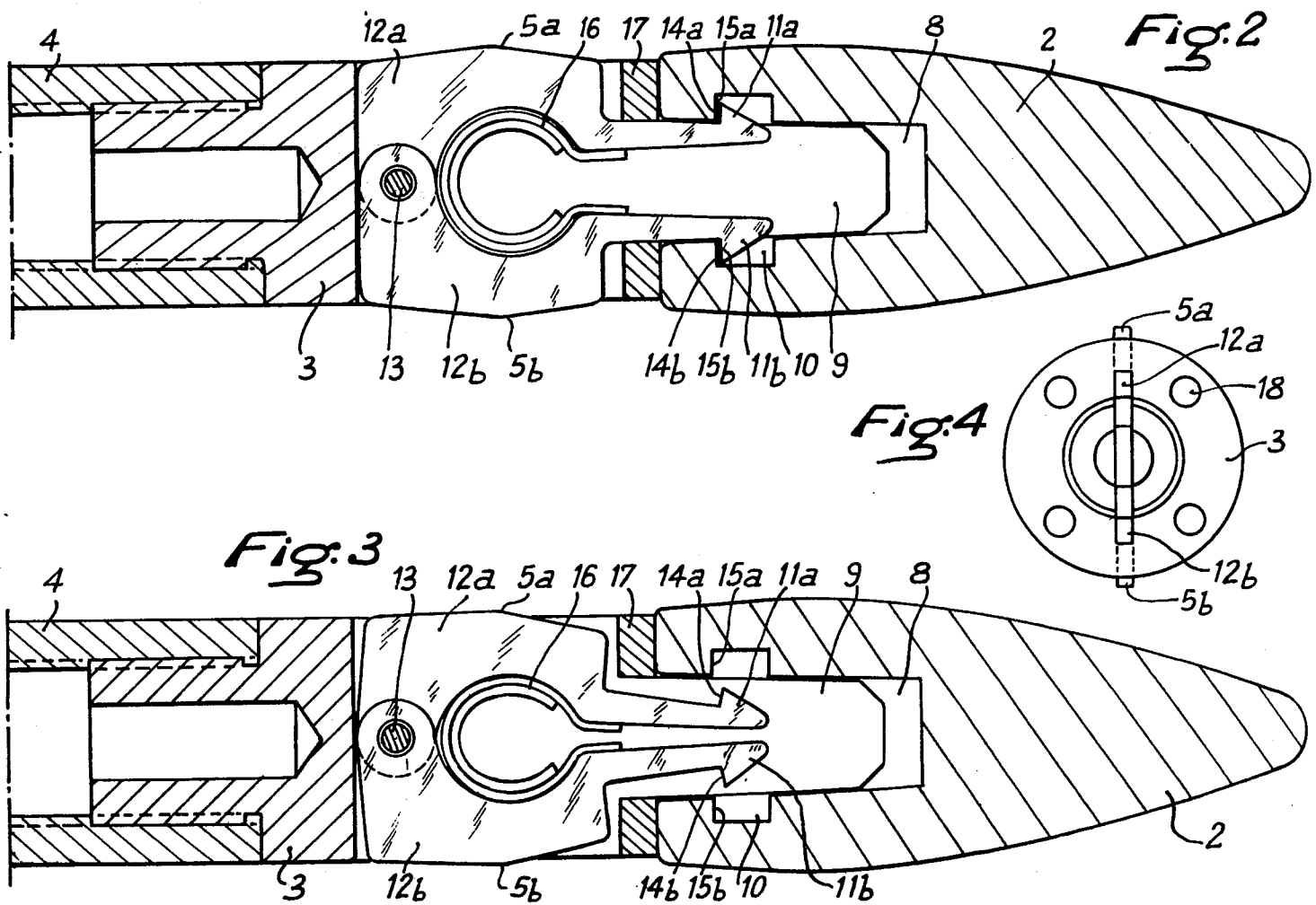
FIG. 2 shows the assembly of plug and mandrel of the apparatus according to the invention.
FIG. 3 shows the the assembly according to FIG. 2, whereby the plug has been disconnected from the mandrel.
FIG. 4 is an end view of the end fitting secured to the mandrel, the plug having been removed.

FIGS. 2 and 3 show in detail a detachable interlocking mechanism used within the scope of the apparatus of the present invention.

The end fitting 3 secured to the end of mandrel 4 has, as described hereinbefore a front portion 9 which penetrates a correspondingly shaped cavity 8 provided within plug 2.

End fitting 3 is provided with elastic plates 12 a and 12 b made from spring steel and these are secured to end fitting 3 by a common shaft 13 constituted for example by a gudgeon or an identical fixing member.

Each of these plates 12*a* and 12*b* have a projecting portion 5*a* and 5*b* and extensions in the form of grips 11*a* and 11*b*. These extensions in the form of grips each have a planar surface 14*a* and 14*b* respectively which are supported on a free edge 15*a* and 15 *b* respectively of the annular groove 10 made within plug 2. It can be seen from FIG. 2 that through the respective arrangement of grips ll*a* and 11*b* and annular groove 10 having free edges 15*a* and 15*b* of plug 2, the release of the plug and the end fitting fixed to the mandrel is prevented when a longitudinal pulling force is exerted on the end fitting or on the mandrel, which ensures a locking which cannot be freed if the plug is pulled from the mandrel.

As can be seen in FIG. 2, within the elastic members 12*a* and 12*b* are provided spring plates 16 arranged in a substantially circular manner and which exert a restoring force which moves the elastic plates 12*a* and 12*b* and therefore hooks 11*a* and 11*b* towards the locking position shown in FIG. 2.

In the position shown in FIG. 3, it is assumed that an external pressure is exerted on the projecting portions 5*a* and 5*b* of elastic plates 12*a* and 12*b*, as is effectively the case in the phases corresponding to Diagram *C and E* of FIG. 1.

Such a pressure ensures in opposition to the elastic force of plates 16, a moving together towards the inside of grips 11*a* and 11*b* which "cancel out" within the extension 9 of end fitting 3 and are disengaged from the annular groove 10 of plug 2. It is then merely necessary to gently longitudinally pull either the mandrel or the plug to free the mandrel from the plug. According to the invention, a ring 17 is also provided which is integral with end fitting 3 for locking the elastic plates 12*a* and 12*b* and preventing the spring plates 16 from moving to the outside under the restoring force.

FIG. 4 shows an end view of end fitting 3 once the plug has been withdrawn, i.e., a view of end fitting 3 of mandrel 4 corresponding to Diagram D of FIG. 1 when plug 2 is contained within slot 7*a* of receptacle 6. At 18 in FIG. 4 members such as gudgeons or the like are shown which permit the fixing of the end fitting on the mandrel.

Obviously, although the invention has been described for a preferred embodiment, it is in no way limited thereto and all desirable modifications can be made thereto without passing beyond the scope of the invention.

In particular, although a detachable interlocking mechanism for plug and mandrel has been shown, it is also possible to use other types of mechanism and in particular electromagnetic pneumatic and hydraulic types for interlocking plug and mandrel provided however that the fitting and removal of operations of plug relative to spindle can be performed to the rear of the rollers of the drilling machine towards the end of the rearward displacement of the mandrel following the withdrawal of the integral mandrel and plug to the rear of the blank.

What we claim is :

1. In a tube forming machine comprising a mandrel which carries at one end a detachable plug which is driven into the work, means for axially reciprocating said mandrel between a work-engaging position and a retracted position remote from said work, plug-gripping means for attaching said plug to and separating said plug from said mandrel, means for actuating said plug-gripping means, the improvement according to which said actuating means is positioned along the path of travel of said mandrel and between said work-engaging and retracted positions, and said actuating means comprises a cylindrical member coaxial with said mandrel having a passage therein through which said mandrel extends when in work-engaging position, said passage having a first section large enough to receive said plug, and a second section too small to receive said plug, and said plug-gripping means being normally located in a plug-gripping position, but urged into a plug-releasing position by contact with the inner wall of said second passage section.

2. Machine as claimed in claim 1 in which said plug gripping means comprise at least two hooks carried by said mandrel end to swing about at least one axis perpendicular to the axis of said mandrel between a radially outward gripping position and a radially inward release position.

3. Machine as claimed in claim 2 in which said hooks have portions which project radially outward from said mandrel when said hooks are in gripping position and are forced inwardly when said mandrel end is retracted into said second passage section.

4. Machine as claimed in claim 3 in which the surfaces of said hooks remote from said mandrel are bevelled and said plugs have internal recesses the walls of which strike said bevelled surfaces and thereby cam said hooks inward as said mandrel approaches said plug.

5. Machine as claimed in claim 1, comprising means for automatically substituting one plug for another while said mandrel is in its retracted position.

* * * * *